United States Patent [19]

Schwartz

[11] 4,020,305

[45] Apr. 26, 1977

[54] REMOTE ACTUATED SWITCH

[75] Inventor: Edwin L. Schwartz, Los Angeles, Calif.

[73] Assignee: Rite Autotronics Corporation, Los Angeles, Calif.

[22] Filed: Aug. 25, 1975

[21] Appl. No.: 607,253

[52] U.S. Cl. ..... 200/159 R

[51] Int. Cl.[2] ..... H01H 13/50

[58] Field of Search ..... 200/61.76, 61.79, 61.81, 200/61.82, 154, 159 A, 160, 241, 242, 246, 243, 164 R, 164 A, 165, 283, 293–296, 303, 159 R

[56] References Cited

UNITED STATES PATENTS

| | | | |
|---|---|---|---|
| 2,626,336 | 1/1953 | Chute | 200/61.76 X |
| 3,211,872 | 10/1965 | Baer | 200/159 R |
| 3,223,813 | 12/1965 | Lewandowski | 200/159 R |
| 3,888,807 | 6/1975 | Lockard | 200/159 R X |

*Primary Examiner*—James R. Scott
*Attorney, Agent, or Firm*—Robert E. Geauque

[57] ABSTRACT

A remote actuated switch capable of carrying relatively large conductive current with the use of small, leaf spring contacts which have upturned ends providing first substantial point contact areas upon initial contact with a contact ring and providing larger contact areas with the contact ring upon bending of the contacts by movement of the plunger carrying the contact ring; the plunger being slidably movable in the housing and spring biased to switch open position.

5 Claims, 4 Drawing Figures

REMOTE ACTUATED SWITCH

BACKGROUND OF THE INVENTION

Remote actuated switches have been utilized as starter switches to start the engine of an automobile from outside the automobile. The automobile starters have been low amp devices and the making and breaking of the contact points of the switch did not materially effect the points. However, the starter current drain on starters has risen substantially and larger inductive currents are experienced at the switch contacts. The large current drain through the switch causes damage at the contact points at the point of make and break for the circuit. In one prior art device, the make and break contact is made by a plunger forcing a cross-piece of an outside spring into contact with an inside spring and a large contact area continually exists between the two springs at the make and break points. Thus, considerable burning and corrosion of the contact area can develop and this area keeps increasing in resistance because of the corrosion. Eventually, the contact areas will be damaged to the extent that the switch will no longer function.

SUMMARY OF INVENTION

The present invention relates to a remote starter switch which can carry a relatively large inductive current with the use of small, low cost contacts. Each of the two contacts are in the form of leaf springs which have a fast breaking point contact formed by an upturned end. The fast breaking substantially point is the first connection between the contacts when a plunger carrying a metallic contact ring engages the upturned end of each contact. Further movement of the plunger causes the metal contact ring to also engage a second larger flat area of each contact. The main current conduction is through the larger contact areas while the make and break point is at the upturned end and this is the only point at which the deterioration of the contacts can result. Deterioration at the point contacts is not critical because the larger second contact areas are effective only after conduction has already commenced through the point contact at the upturned ends. The high inductive loads at make and break are only felt by the contact points. Thus, the present invention provides a remote starter switch which is capable of handling relatively large inductive current with only small, low cost contacts.

DESCRIPTION OF THE PREFERRED EMBODIMENT

Figure 1:
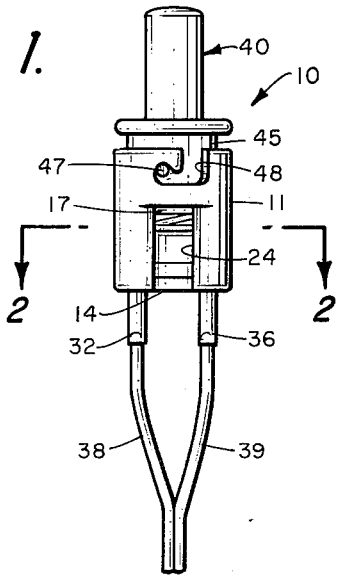
FIG. 1 is a side elevational view of the remote starter switch of the present invention showing the starter button and the electrical leads.

The remote starter switch 10 of the present invention has a cylindrical housing 11 with an internal bore 12. A partition 14 extends across the bottom of housing 11 and contains a central cavity or recess 15 which receives one end 17*a* of spring 17. Also, partition 14 contains openings 19 and 20 and lip 21 around the top of cavity 15 extends higher than the top surface of partition 14. Openings 24 and 25 are located in opposite sides of housing 11 for cooling purposes (see FIG. 2) and cavities comprising spaces 26 and 27 are located in opposite side walls 14*a* and 14*b*, respectively of partition 14.

A first switch contact 30 comprises a leaf spring which has an upturned outer end 30*a*, connected to a flat section 30*b* which in turn is connected to end 30*d* by angular section 30*c*. End 30*d* connects with split sleeve 31 into which is pressed rivet 32 having an enlarged head 32*a*. Similarly, a second contact 34 has an upturned outer end 34*a* connected to a flat section 34*b* which in turn is connected to end 34*d* by angular section 34*c*. End 34*d* connects with split sleeve 35 into which is pressed rivet 36 having an enlarged head 36*a*. External leads 38 and 39 connect to rivets 32 and 36, respectively, and the switch makes and breaks the current between the leads. Rivet 32 and 36 are prevented from passing through openings 19 and 20, respectively because of the engagement of contact ends 30*d* and 34*d*, respectively, with the top of partition 14. Curved cutouts 12*a* are located in the wall 11 to facilitate the insertion of the rivets 32 and 36 downwardly through the bore 12 and into the openings 20 and 19, respectively. The flat sections 30*b* and 34*b* have curved edges 30*e* and 34*e* which are located around upturned lip 21 to locate the contacts 30 and 34 over spaces 26 and 27, respectively, so that the contact outer ends can bend downwardly into the spaces.

A plunger 40 is closed at top end 40*a* and contains a bore 40*b* which communicates with open end 40*c* and receives the other end 17*b* of the spring. A metal eyelet 42 is tightly inserted into bore 40*b* and has a circular end flange 43 which overlaps open end 40*c* of the plunger. The flange 43 comprises the contact ring which electrically connects contacts 30 and 34 together upon movement of the plunger against the force of spring 17. Plunger 40 is slidable in bore 45*a* of guide 45 which also has a step 45*b* engaged by a shoulder 40*d* on plunger 40. Guide 34 fits snugly into the end of bore 12 of housing 11 and has two pins 47 projecting from opposite sides. Also, housing 11 contains two bayonet type openings 48 (only one shown), each of which receives a pin 47 in order to secure the guide 45 to the housing. The pressure of spring 17 normally holds the pins 47 against the top of the bayonet openings 48 and holds flange 40*d* of plunger 40 against step 45*b* (see FIG. 1). A no-conductive fiber washer 50 is located below the end 45*e* of guide 45 and is of sufficient size to permit passage of contact ring 43 and plunger 40 therethrough in order to engage the contacts. The washer 50 serves to protect the guide end against heat created at the contacts.

Figure 3:
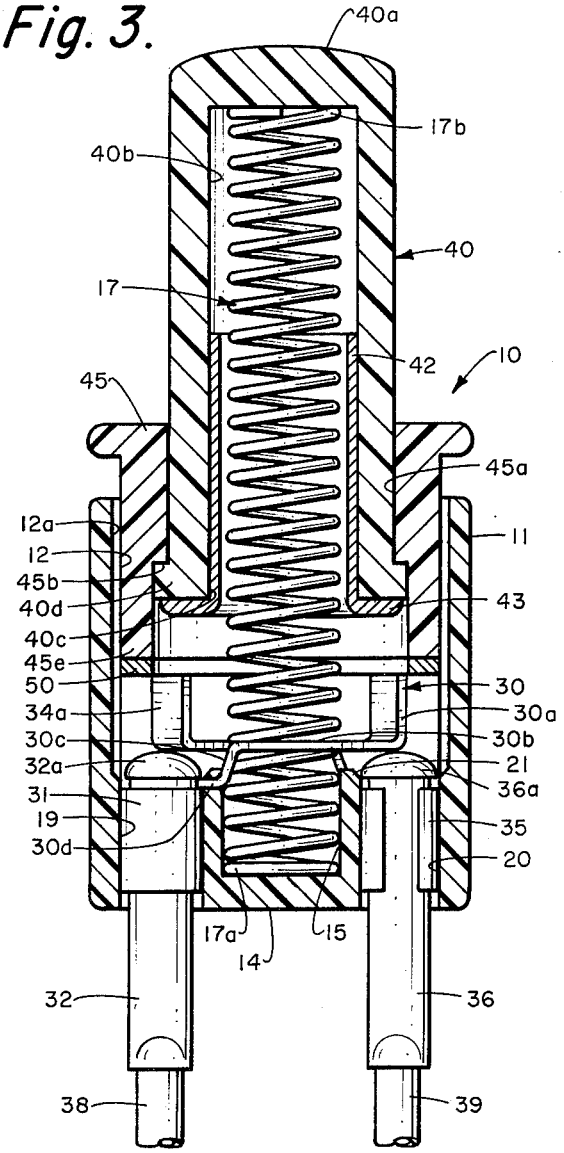
FIG. 3 is a vertical section along 3—3 of FIG. 2 illustrating the switch in open condition and showing the plunger which carries a contact ring for connecting between the contacts.

To assemble the switch, the rivets 32 and 36 with the contacts 30 and 34 attached thereto are inserted into the openings 19 and 20 and the contacts are aligned around the lip 21 so that each contact is over a cavity in the housing. Plunger 40 is then inserted through the opening in guide 45 and the ends of spring 17 are inserted into cavity 15 and plunger bore 40*b*. Thereafter, washers 50 and guide 45 are inserted into the housing 11 and the guide is turned so that a bayonet type connection is obtained between pins 47 and housing openings 48. The spring 17 holds plunger 40 and contact ring 43 away from the upturned ends of the contacts (see FIG. 3).

Figure 2:
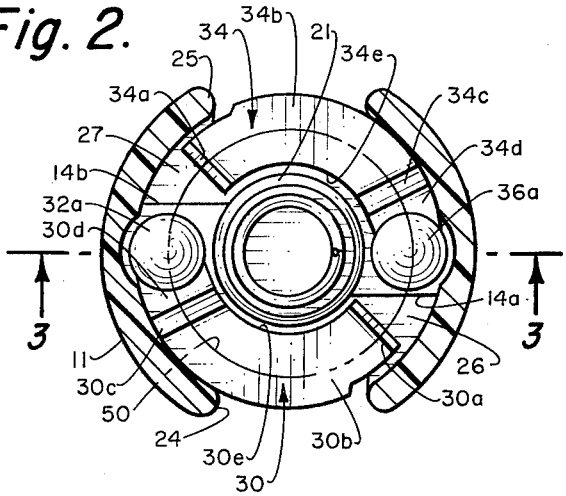
FIG. 2 is a horizontal section along line 2—2 of FIG. 1 showing the leaf spring contacts connected to the rivets which are also connected to the exterior leads.
Figure 4:
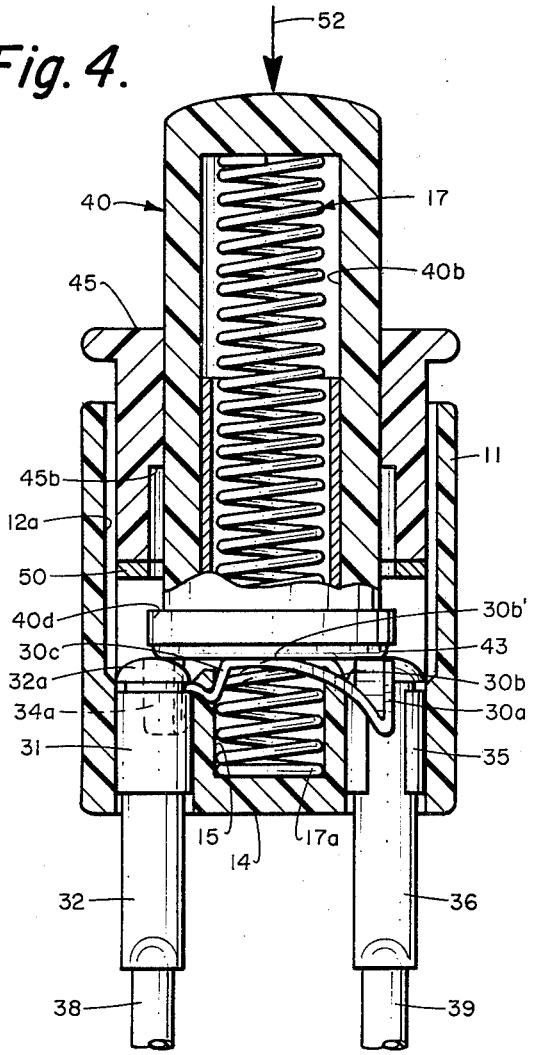
FIG. 4 is a vertical section similar to FIG. 3 showing the switch in closed position with the plunger ring engaging two contacts areas of each contact.

When it is desired to close the switch, a force in the direction of arrow 52 is applied to the plunger 40 causing compression of spring 17 and movement of contact ring 43 first against the top portion of upturned contact ends 30*a* and 34*a* which are not shielded by washer 50 (see FIG. 2). The tops of the contact ends will be the first contact areas. Further downward movement of plunger 40 causes the flat section 30*b* and 34*b* to bend as the upturned ends 30*a* and 34*a* move into cavities 26 and 27, respectively. After bending, contact ring 43 engages second contact areas comprising larger contact portions of flat sections 30*b* and 34*b* (see portion 30*b'* of FIG. 4). Thereafter, the current between leads 38 and 39 will be primarily through the contact portions of flat section 30*b*, 34*b* and the contact ring.

When it is desired to open the switch, the pressure on plunger 40 is removed and spring 17 will raise the contact ring 43 away from the contacts. The first contact portions to break contact will be the larger portion of the flat sections and the last portions to break contact will be the tops of contact ends 30*a* and 34*a* which were also the first portions to make contact. The tops of the contact ends provide fast breaking, point contacts where the make and break of the switch occurs. Thus, any burning and corrosion will therefore occur at these points and there will be no such deterioration at the larger, second contact areas of the flat sections 30*b* and 34*b*. Since the second contact areas will be clear of corrosion and burning, there will be an excellent conduction between the two contact areas and the contact ring. Also, since plunger 40 is fully rotatable within the housing 11, fresh areas of the contact ring can be continually brought against the first and second contact areas of the contacts so that excessive burning and corrosion of contact ring 34 can be prevented. Thus, the switch is capable of carrying relatively large inductive currents with the use of small, low cost contacts which isolate the burning and corrosion occurring on make and break to small contact areas.

What is claimed is:

1. A remote actuated switch comprising:

a housing;

a plunger movably mounted in said housing;

a contact ring at the end of said plunger for opening and closing said switch;

a spring for normally biasing said plunger to the switch open position;

said switch comprising a pair of contacts located in said housing opposite said contact ring;

a pair of external leads, one being attached to each of said contacts through which current flows when said contact ring is moved by said plunger against both said contacts;

each of said contacts comprising a flexible metal spring member having a flat section and an upturned end;

each contact being located over a separate cavity in said housing to permit bending of said contact by movement of said plunger after engagement of said contact with said contact ring;

said upturned ends being the first contact area of said contacts with said contact ring upon initial engagement with said plunger; and portions of said flat sections of said contacts providing larger, second contact areas with said contact ring when said flat sections bend upon further movement of said plunger against said upturned ends.

2. A switch as defined in claim 1;

a partition at one end of said housing and supporting said contacts;

a sleeve connected to one end of each said contacts opposite said upturned end;

a rivet extending through each of said sleeves; and two openings in said partition each receiving an assembled rivet and sleeve;

one of said external leads being connected to each of said rivets.

3. The switch as defined in claim 2;

said partition having a recess for receiving one end of said spring; and a projecting lip on said partition and around said recess for positioning each of said contacts over one of said separate cavities.

4. A switch as defined in claim 1;

a guide for said plunger secured within said housing and having an internal step limiting movement of said plunger;

a bore in said plunger; and a metallic eyelet secured in said bore and having a flange bent over one end of said plunger to form said contact ring.

5. A switch as defined in claim 4;

a washer located between one end of said guide and said upturned ends of said contacts in order to protect said guide from said contacts.

* * * * *